US005205231A

United States Patent [19]

Sanvito et al.

[11] Patent Number: 5,205,231

[45] Date of Patent: Apr. 27, 1993

[54] SELF-ADJUSTING PRESSER FOOT FOR ASSEMBLER SEWING MACHINES

[75] Inventors: Roberto Sanvito, Buccinasco; Franco Marchesi, San Martino Siccomario; Davide Artioli, San Giorgio Su Legnano, all of Italy

[73] Assignee: Rimoldi, S.R.L., Milan, Italy

[21] Appl. No.: 838,536

[22] Filed: Feb. 19, 1992

[30] Foreign Application Priority Data

Apr. 30, 1991 [IT] Italy ..... MI91A00178

[51] Int. Cl.[5] ..... D05B 29/00; D05B 37/00

[52] U.S. Cl. ..... 112/235; 112/126; 112/127

[58] Field of Search ..... 112/235, 236, 127, 122, 112/126

[56] References Cited

U.S. PATENT DOCUMENTS 4,526,113 7/1985 Angele ..... 112/235 X

FOREIGN PATENT DOCUMENTS 836728 4/1952 Fed. Rep. of Germany ..... 112/235

857154 11/1952 Fed. Rep. of Germany ..... 112/235

609507 4/1956 Fed. Rep. of Germany ..... 112/235

2921839 12/1980 Fed. Rep. of Germany ..... 112/235

644152 9/1962 Italy ..... 112/235

2240554 7/1991 United Kingdom ..... 112/235

*Primary Examiner*—Clifford D. Crowder

*Assistant Examiner*—Paul C. Lewis

*Attorney, Agent, or Firm*—Laff, Whitesel, Conte & Saret

[57] ABSTRACT

A presser foot having a shoe comprising a pair of mutually facing front portions (5a, 5b) and a pair of rear portions (6a, 6b) in alignment with the front portions (5a, 5b) and connected thereto by a pair of side rocker arms (7a, 7b). The side rocker arms (7a, 7b) are pivotably supported by swinging arms (10a, 10b) linked to a small bearing frame (2). A center rocking arm (15) mounted on the bearing frame (2) acts by a pair of laterally disposed pistons (17a, 17b) on the individual swinging arms (10a, 10b) in order to mutually balance the fulcra of the side rocker arms (7a, 7b). Operating at a longitudinal opening (29) defined between the front portions (5a, 5b) is a fixed knife (32) and a movable knife (33) which are adjustable independently of each other in their vertical positioning relative to the shoe (4).

17 Claims, 2 Drawing Sheets

SELF-ADJUSTING PRESSER FOOT FOR ASSEMBLER SEWING MACHINES

BACKGROUND OF THE INVENTION

1. Field of the Invention

The present invention relates to a self-adjusting presser foot for assembler sewing machines, of the type comprising: a small bearing frame fixedly fastened to a presser bar of the sewing machine; a shoe which is engaged at the lower part thereof to the small bearing frame, is arranged to act in elastic-thrust relationship on two fabric pieces to be assembled, and exhibits a longitudinal opening designed to receive and guide two opposite edges of said fabric pieces disposed in mutual side by side relation, as well as a transverse slit for access to sewing means adapted to firmly joint said fabric pieces by a seam of stitchings along said opposite edges; cutting means acting close to said longitudinal opening for trimming the side by side fabric piece edges, upstream of the transverse slit; and guide means formed at one end of said longitudinal opening and acting downstrean of the cutting means and upstream of the transverse slit in order to mutually overlap the trimmed fabric piece edges.

2. Prior Art

It is known that assembler sewing machines are used to mutually joint two or more fabric pieces being part of a workpiece and disposed in coplanar side by side relation on the sewing machine worktable. In greater detail, the mutual assembling of the two fabric pieces takes place through mutual overlapping and sewing of the opposite edges thereof.

For the purpose, in assembler sewing machines a particular presser foot is normally provided which is conceived so that it can trim the opposite edges of the fabric pieces to be joined together and lead the trimmed edges under a condition of mutual overlapping to the area in which the sewing is to be carried out.

To this end, the presser foot is substantially comprised of a small bearing frame fixedly connected to the presser bar of the sewing machine and carrying a shoe at the lower part thereof which is designed to elastically act against the fabric pieces disposed in mutual side by side relation, over feed dogs that, as known, act through a needle bar associated with the machine worktable in order to cause the movement of the fabric pieces in the sewing direction.

The shoe has a longitudinal opening at the front into which the opposite edges of the fabric pieces turned upwardly and mutually mating are introduced.

Operating at the longitudinal opening is cutting means substantially comprising a fixed knife rigidly engaged to the shoe so that it projects sideways towards the inner part of the opening and a movable knife elastically urged against the fixed knife and operated with oscillatory motion in the transverse direction relative to the opening. In this way, the cooperation between the fixed and movable knives causes the trimming of the edges of the fabric pieces that, by effect of the workpiece moving forward, are gradually introduced into the longitudinal opening.

The longitudinal opening terminates in a shaped end so that the trimmed fabric piece ends can be disposed in the same plane as the fabric pieces in mutual overlapping relation before their having access to the area in which by means of one or more needles cooperating with one or more loopers, a seam of stitches fixedly joining said edges is formed.

Usually, in combination with the presser foot of the above described type a needle-plate is used which is provided with a stepped surface recess extending substantially along the sewing direction. In this way, one of the fabric pieces is disposed, at least close to its edge to be sewn to the other fabric piece, according to a plane slightly lower than the other fabric piece in order to avoid the thickness increase due to the overlapping of said edges causing a partial loss of contact between the shoe and the individual fabric pieces.

In order to compensate for thickness variations in the workpiece as much as possible, it is also provided for the shoe to act on the fabric pieces by a pair of elastic compensating foils substantially in the shape of small leaf springs and extending parallelly along the lower shoe surface.

However, notwithstanding the above described expedients, presser feet presently used in the above described assembler sewing machines still have some drawbacks. In fact, due to the fact that the pressure exercised by the shoe on the individual fabric pieces is caused not only by the elastic thrust exerted through the presser bar, but also by the extent of elastic flection undergone by the elastic foils, it is very difficult to achieve a uniform specific pressure throughout the whole contact surface between the shoe and the fabric pieces. In particular, also due to the surface recess present on the needle-plate, it often happens that there is a fabric piece having a specific pressure lower than that produced on the other fabric piece. Clearly, this situation can impair the correct feeding of the workpiece while a sewing is being carried out.

In addition and above all, it is very difficult to achieve a uniform working when, during the workpiece advancing, the shoe of the presser foot meets thickness increases due for example to the presence of folded back edge pieces and/or inserts of various kinds, such as tapes or the like, previously applied to the fabric pieces.

Under this situation, in fact, it often happens that the fabric piece edges located close to the thickness increase are not overlapped. On the contrary, in these areas the fabric piece edges slide away from each other and are undesirably spread apart before the sewing is carried out.

In addition, since the shoe is compelled to lift in order to step over the thickness increase, sewing irregularities in the areas adjacent to this thickness increase also occur.

It is also noted that, since the fixed knife is directly mounted on the shoe, the lifting of the latter also gives rise to irregularities in the trimming of the fabric piece edges.

SUMMARY OF THE INVENTION

The main object of the present invention is to solve the problems of the known art by providing a presser foot capable of automatically and immediately adapting to any thickness variation in the fabric pieces being worked. In particular, the presser foot must be capable of keeping the specific pressure exercised on the individual fabric pieces constant and uniform, irrespective of the thickness exhibited by the workpiece and possible differences in thickness between two fabric pieces, as well as sudden thickness variations of the fabric pieces while a seam is being carried out.

The trimming of the fabric piece edges too must be executed in an optimal manner, irrespective of the movements carried out by the shoe for suiting the different work conditions.

The foregoing and further objects that will become more apparent in the course of the present description are substantially attained by a self-adjusting presser foot for assembler sewing machines, wherein said shoe comprises a pair of front portions disposed parallelly in side by side relation and defining said longitudinal slit; a pair of rear portions each disposed in alignment with one of said front portions; a pair of side rocker arms each of whiich oscillatably engages, according to horizontal axes transverse to the sewing direction, one of said front portions and one of said rear portions in respective alignment; a pair of interconnecting elements oscillatably engaged to the small bearing frame and each carrying a fulcrum pin for one of said side rocher arms, the axes of oscillation of said side rocker arms being oriented horizontally in a direction perpendicular to the sewing direction; a center rocker arm oscillatably engaged to the small bearing frame according to a horizontal axis parallel to the sewing direction and exhibiting its opposite ends operatively connected to the interconnecting elements in order to balance the fulcrum pins of the side rocker arms.

BRIEF DESCRIPTION OF THE DRAWINGS

Further features and advantages will be better understood from the detailed description of a preferred embodiment of a self-adjusting presser foot for assembler sewing machines in accordance with the present invention, given hereinafter by way of non-limiting example with reference to the accompanying drawings, in which.

DETAILED DESCRIPTION OF THE PREFERRED EMBODIMENT

Figure 1:
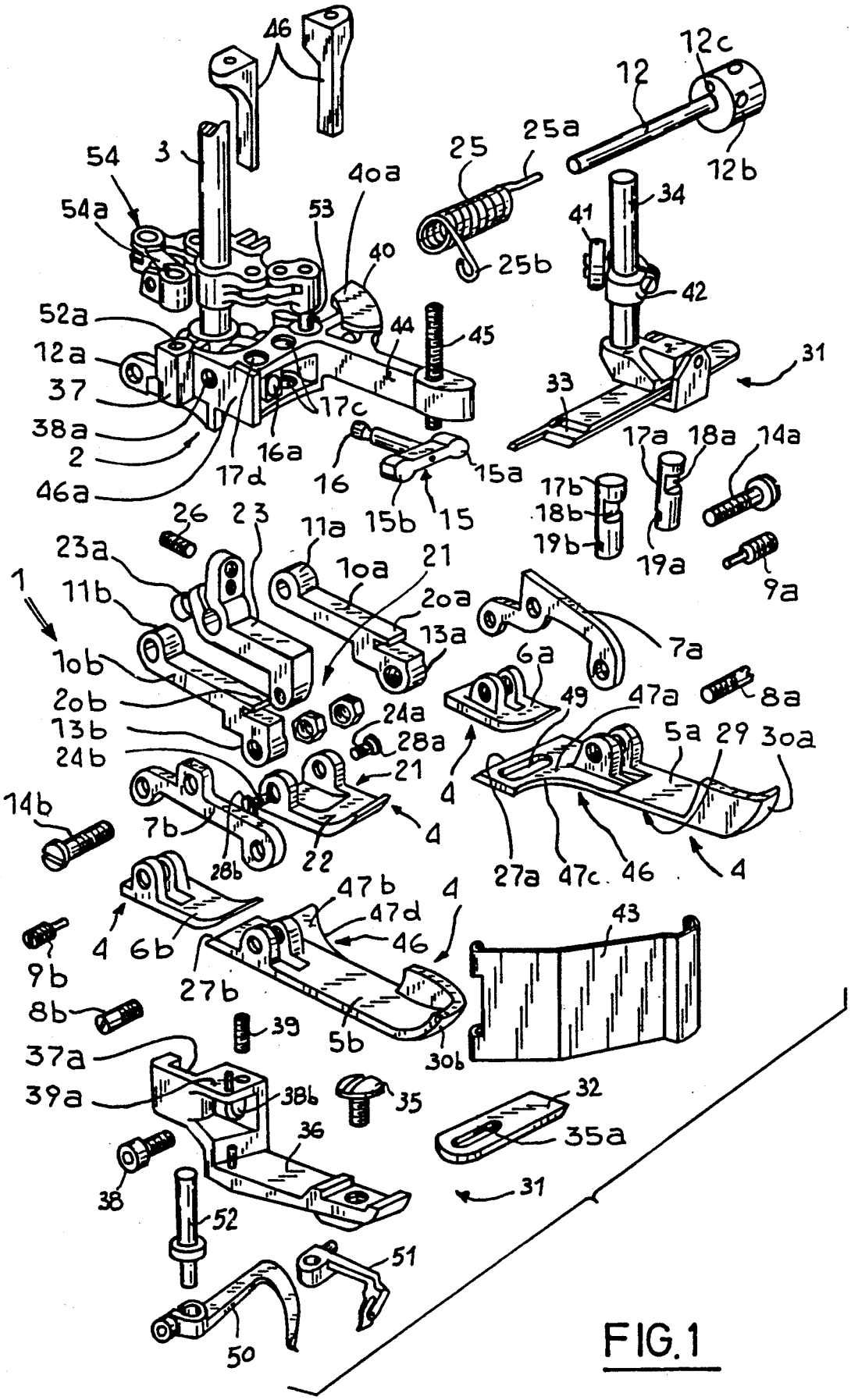
FIG. 1 is an exploded perspective view of the presser foot of the invention.

Referring to the drawings, a self-adjusting presser foot for assembler sewing machines in accordance with the invention has been generally identified by reference numeral 1.

Referring particularly to FIG. 1, the presser foot comprises a small bearing frame 2 rigidly fastened to a presser bar 3 belonging to a sewing machine not shown as known per se and conventional. In known manner, the presser bar 3 is submitted to the action of a spring (not shown) or similar means in order to push the whole presser foot 1 downwardly.

Engaged under the small bearing frame 2 is a shoe 4 arranged to act in elastic thrust relation by effect of the action carried out through the presser bar 3, on two fabric pieces to be assembled, laid down in mutual side by side relation on a worktable belonging to the above mentioned sewing machine.

In greater detail, the shoe 4 acts, as known, above feed dogs acting through a needle plate associated in coplanar relation with the worktable, so as to cause the fabric pieces to be dragged along according to a predetermined sewing direction.

The fabric pieces, worktable, needle-plate and feed dogs have not been shown in the accompanying drawings as known per se and not of importance to the ends of the invention.

In accordance with the present invention, the shoe 4 comprises a pair of right and left front portions, 5*a* and 5*b* respectively, disposed parallelly in mutual side by side relation and a pair of right and left rear portions, 6*a* and 6*b* respectively, each disposed in alignment with one of the front portions 5*a*, 5*b*.

The right front and rear portions 5*a*, 6*a* and left front and rear portions 5*b*, 6*b* are oscillatably linked, according to horizontal axes transverse to the sewing direction, to the opposite ends of respective right and left side rocker arms 7*a*, 7*b*, through respective front and rear swinging pins, 8*a*, 8*b* and 9*a*, 9*b* respectively.

Moreover, the right and left side rocker arms 7*a*, 7*b* are pivotally mounted, in this case too being able to oscillate about a horizontal axis perpendicular to the sewing direction, to respective interconnecting means 10*a*, 10*b* oscillatably connected to the small bearing frame 2 so as to give the side rocker arms the possibility of carrying out a vertical oscillation at the respective fulcra.

In the embodiment shown the side rocker arms 7*a*, 7*b* have different geometric configurations with respect to each other. However it should be noted that they are identical in the positioning of the respective pivot points with the interconnecting elements 10*a*, 10*b* and the front and rear portions 5*a*, 5*b* and 6*a*, 6*b*.

Preferably said interconnecting elements consist of respective swinging arms, a right arm 10*a* and a left arm 10*b* respectively, each of which has one end 11*a*, 11*b* disposed rearwardly which is oscillatably engaged to the small bearing frame 2, still according to an axis at right angles to the sewing direction.

In greater detail, the first ends 11*a*, 11*b* of the right 10*a* and left 10*b* swinging arms are rotatably mounted to a connecting shaft 12 in turn rotatably engaged, for purposes to be described below, by means of two pierced tabs 12*a* (only one of which is shown in FIG. 1) projecting rearwardly from the small bearing frame 2.

The swinging arms 10*a*, 10*b* also exhibit second ends 13*a*, 13*b* oscillatably engaging the right and left rocker arms, 7*a* and 7*b*, upon interposition of fulcrum pins 14*a*, 14*b*.

Still in accordance with the present invention, the swinging arms 10*a*, 10*b* are mutually interconnected by a center rocker arm 15 the function of which is that of balancing the pivot fulcra defined by the fulcrum pins 14*a*, 14*b*, of the side rocker arms 7*a*, 7*b*. To this end the center rocker arm 15 has a hinging shank 16 extending at right angles from the rocker arm center and rotatably engaging, according to an axis parallel to the sewing direction, into a hole 16*a* formed in the small bearing frame 2. The rocker arm 15 also has two end projections, a right one 15*a* and left one 15*b*, interconnected with the swinging arms 10*a*, 10*b* through a pair of connecting pistons 17*a*, 17*b* slidably engaged in a vertical direction in respective holes 17*c*, 17*d* formed in the small bearing frame 2.

Each connecting piston 17*a*, 17*b* has an engagement seat 18*a*, 18*b* oscillatably housing the corresponding end projection 15*a*, 15*b* of the center rocker arm 15, as well as a holding seat 19*a*, 19*b* engaging with a fitting lug 20*a*, 20*b* carried by the corresponding swinging arm 10*a*, 10*b*.

Preferably, also associated with the shoe 4 is a presser element generally denoted by 21 and arranged to exert an elastic thrust action oriented downwardly at a centered position between the right 6a and left 6b rear portions. The presser element 21 is comprised of an additional shoe portion 22 interposed between the rear portions 6a, 6b and engaged to an additional arm 23 by a pair of additional pivot pins 24a, 24b giving it the possibility of oscillating according to a horizontal axis perpendicular to the sewing direction.

The additional arm 23 is oscillatably connected to the small bearing frame 2 and submitted to the action of spring means operating such as to elastically urge the additional shoe portion 22 downwardly. In greater detail, the additional arm 23 is provided to be fastened by a clamp end thereof 23a to the connecting shaft 12 rotatably engaged with the small bearing frame 2. Said spring means consists of a torsion spring 25 one end 25a of which is engaged in a hole 12c formed in a head 12b of the connecting shaft 12 and the other end 25b being linked to the small bearing frame 2. By loosening the clamp end 23a and rotating the connecting shaft 12 it is possible to adjust the preload exerted by the torsion spring 25.

An adjusting headless screw 26 associated with the clamp end 23a acts in abutment on the rear part of the small bearing frame 2 so as to define the end of the descent stroke of the additional shoe portion 22.

In accordance with another feature of the present invention, the shoe 4 is provided with stop means designed to restrain the downward swinging of the front portions 5a, 5b. Preferably, in accordance with this stop means each front portion 5a, 5b is provided, along its edge facing the corresponding rear portion 6a, 6b, with an abutment seat 27a, 27b arranged to act against the rear portion itself so as to restrain the rotation of said front portion about its hinging point with the corresponding side rocker arm 7a, 7b.

Still in accordance with said stop means, for each of the rear portions 6a, 6b a second abutment seat 28a, 28b is formed on the additional shoe portion 22, which second abutment seat is designed to act against the rear portions themselves in order to restrain the lifting thereof following a rotation of the side rocker arms 7a, 7b about the respective fulcrum pins 14a, 14b. In the embodiment shown the second abutment seats 28a, 28b are embodied by the heads of the additional pivot pins 24a, 24b.

In a manner known per se, defined between the front portions 5a, 5b of the shoe 4 is a longitudinal opening 29 designed to receive and guide two opposite edges of the fabric pieces that are fed under the presser foot 1. In greater detail, at the inlet of the longitudinal opening 29 the fabric piece edges are guided by appropriate engagement ends 30a, 30b provided ahead of the front portions 5a, 5b, so that they are vertically lifted relative to the portions themselves, mating with each other.

Under this situation the edges of the fabric pieces can be trimmed by cutting means 31 operating close to the longitudinal opening 29. This cutting means substantially comprises a fixed knife 32 rigidly connected to the small bearing frame 2 and a movable knife 33 held in cantilevered fashion by a driving rod 34. In known manner and therefore not shown, the movable knife 33 is set in an oscillatory motion substantially transversal to the sewing direction. In this manner, the cooperation between the movable knife 33 and fixed knife 32 causes the trimming of the fabric piece edges.

Preferably, the fixed knife 32 is rigidly connected, by means of a locking screw 35 engaging through an elongated hole 35a to a supporting element in the form of a console 36 to be positioned upright to the small bearing frame 2. In more detail, the console-shaped supporting element 36 is slidably guided on the small bearing frame 2 by a vertical groove 37a matching the shape of a guide ridge 37 exhibited by the frame, to which it is operatively engaged. The positioning of the console 36 and consequently the fixed knife 32 is set by a threaded locking member 38 to be screwed into a threaded hole 38a exhibited by the small bearing frame 2 and passing through the console at a vertical elongated hole 38b. A vertical adjusting headless screw 39 operatively engaged through a plate-like projection 39a carried by the console-shaped supporting element 36 lends itself to come in abutment on the head of the threaded locking member 38 to stop the descent of the console element when the threaded element is loosened. In greater detail, once the threaded locking member 38 has been untightened it is possible to act on the vertical adjusting headless screw 39 in order to snugly adjust the vertical positioning of the fixed knife 32.

In an original manner, in the presser foot 1 of the invention the small bearing frame laterally exhibits a support portion 40 offering a horizontal slide surface 40a for a locator element 41 connected to the movable knife 33. Preferably, the locator element 41 consists of a ball bearing rotatably carried, according to a horizontal axis, by a positioning clamp 42 to be positioned along the driving rod 34.

The slide surface 40a is adapted to receive the locator element 41 thereon so that it may bear the vertical thrusts resulting from the reciprocating rising and lowering movements undergone, as known, by the presser foot 1 upon the action of said feed dogs. In the absence of this technical expedient, the movable knife 33 would be compelled to rise being pushed by the fixed knife 32 which is raised together with the presser foot 1. Consequently, said vertical thrusts would be discharged on the cutting edge of the fixed and movable knives 32 and 33.

Advantageously, by moving the positioning clamp 42 along the driving rod 34 it is possible to modify the positioning in height of the movable knife 33.

In this manner, both the fixed knife 32 and movable knife 33 can be individually positioned in height relative to the shoe 4, in order to adjust the cutting operation on the edges of the fabric pieces being worked. A deflecting partition 43 hinged to the console-shaped supporting element 36 conventionally accomplishes the function of deflecting sideways of the presser foot 1 the off-cuts obtained from the cutting action of the fixed 32 and movable 33 knives.

In accordance with a further feature of the invention, the supporting frame 2 is also provided to exhibit a front extension 44 through which a threaded dowel 45 operatively engages; said dowel is oriented vertically and designed to act on the movable knife 33 in order to counteract the fixed knife 32 moving away during the cutting operation. The side thrust forces resulting from the cutting action of knives 32, 33 are conventionally supported by two side shoulders 46 fastened to the sewing machine structure (not shown) and acting on opposite side surfaces 46a (only one of which is shown in FIG. 1) of the small bearing frame 2.

The longitudinal slit 29 terminates adjacent to guide means 46 acting downstream of the cutting means 31 in order to cause the mutual overlapping of the trimmed edges of the fabric pieces.

In accordance with the present invention, the guide means 46 comprises a first and a second wedge-shaped wings 47*a*, 47*b* each extending from one of the front portions 5*a*, 5*b* towards the other front portion. The first and second wedge-shaped wings 47*a*, 47*b* are mutually overlapped and are joined to the edges of the longitudinal opening 29 by respective curvilinear side portions 47*c*, 47*d* converging towards each other.

In greater detail, the first wedge-shaped wing 47*a* is provided to be overlapped with the second wedge-shaped wing 47*b*. In this way, the fabric piece edge that is disposed under the right front portion 5*a* of the shoe 4, sliding along the curvilinear side portion 47*c* of the first wing 47*a* will be turned horizontally again passing between the first wing 47*a* and the second wing 47*b*.

The edge of the fabric piece located under the left front portion 5*b* in turn will be horizontally directed and will then pass under the second wing 47*b*. In this way the fabric piece edges are disposed in mutual overlapping relation.

Formed on the first wing 47*a* is a transvers slit 49 disposed immediately downstream of the guide means 46 to enable the passage of one or more needles that, in cooperation with other sewing means, fixedly joint the overlapping edges of the fabric pieces by a seam of stitches.

This sewing means, not shown in detail as known per se, comprises, among other things, a pair of upper loopers 50, 51 engaged with a first and a second stem 52, 53 respectively and set in reciprocating motion before the above mentioned needles by a driving kinematic mechanism generally denoted by 54 that receives motion from actuating means conventionally provided in the sewing machine. For the sake of clarity, it should be noted that the first stem 52 is rotatably engaged in a through hole 52*a* formed in the small bearing frame 2 and is anchored at the upper part thereof to a small arm 54*a* being part of the driving kinematic mechanism 54. The same remarks are valid as regards the second stem 53.

As is clear from the foregoing, the operating sequence put into practice by the presser foot 1 on the fabric pieces in order to achieve the mutual assembling thereof does not substantially differ from the operating sequence taking place with known presser feet.

Actually, the fabric pieces dragged along by the feed dogs operating through the needle-plate, get under the front portions 5*a*, 5*b* of the shoe 4 with their respective edges turned vertically and mating with each other.

Moving to the inside of the longitudinal opening 29, the edges of the fabric pieces encounter the fixed and movable knives 32 and 33 that carry out the trimming thereof so as to make them ready for being overlapped to the desired extent. The subsequently achieved overlapping amount can be easily adjusted by modifying the positioning in height of the individual knives 32, 33, as previously described.

Downstream of the cutting means 31, the edges of the fabric pieces are brought into mutual overlapping relation and then sewn close to the transverse slit 49.

Advantageously, during the execution of these operations the mobility of the individual front and rear portions, 5*a*, 5*b* and 6*a*, 6*b* respectively, enables the shoe 4 to automatically adapt itself to any change in thickness occurring in one of the fabric pieces or both of them.

In the connection it should be pointed out that the pressure force exerted on the presser bar 3 is transmitted, before reaching the shoe 4, to the hinging shank 16 of the rocker arm 15, engaged in the small bearing frame 2. The rocker arm 15, in turn, distributes force to the two connecting pistons 17*a*, 17*b*. Consequently pistons 17*a*, 17*b* by acting on the swinging arms 10*a*, 10*b* transmit half the force present on the presser bar 3 to each of the fulcrum pins 14*a*, 14*b* of the side rocker arms 7*a*, 7*b*.

Force in this way applied to each fulcrum pin 14*a*, 14*b* is distributed in a predetermined manner between the corresponding front and rear portions, 5*a*, 5*b* and 6*a*, 6*b* of shoe 4.

Advantageously, these operating conditions keep constant, irrespective of any thickness variation occurring in the workpiece being worked.

Figure 2:
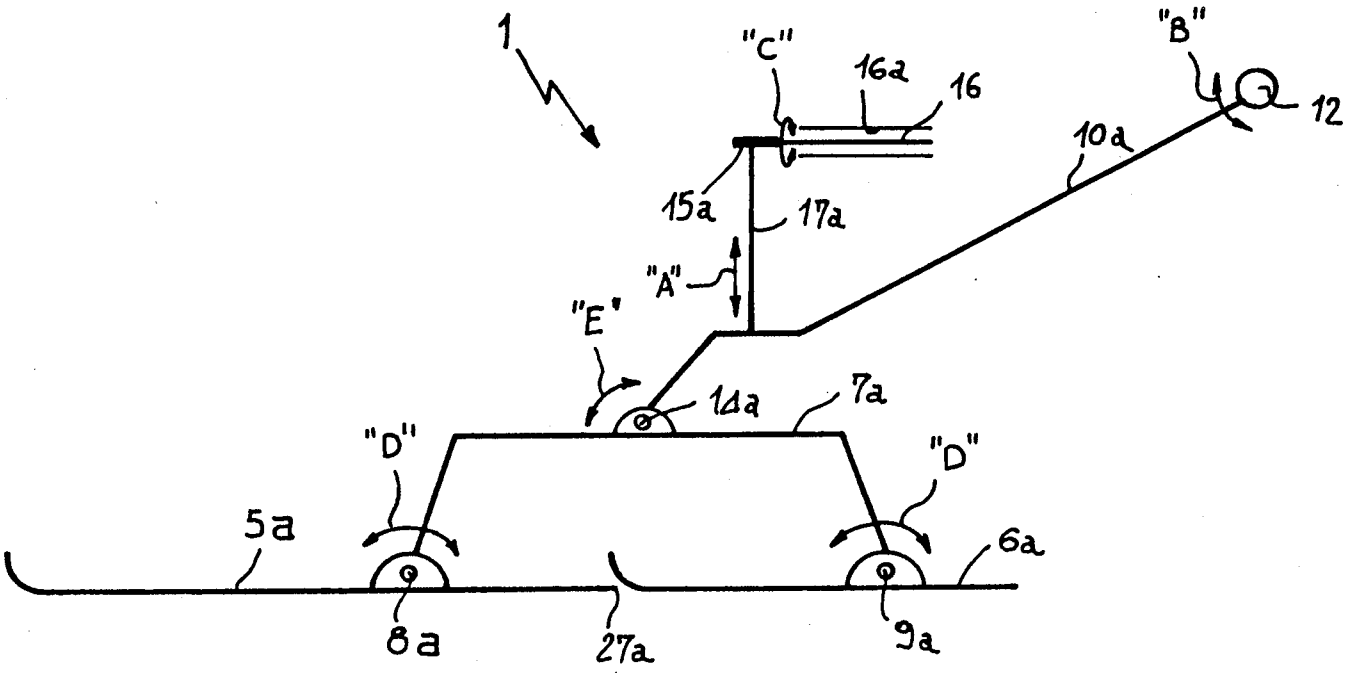
FIG. 2 is a diagrammatic side view of the movement possibilities of the different parts of the presser foot in question so that it can suit thickness variations in the fabric pieces being worked.

In fact, the mobility of the individual front and rear portions 5*a*, 5*b* and 6*a*, 6*b*, graphically shown in FIG. 2, enables the shoe 4 to automatically adapt itself to these variations.

In particular, in case of thickness variation of one of the fabric pieces, the right and left front and rear portions, 5*a*, 6*a* and 5*b*, 6*b* respectively, will move upwardly or downwardly with respect to each other, bringing about a vertical sliding of the connecting pistons 17*a*, 17*b* according to arrow "A" in FIG. 2 and a simultaneous angular rotation of the swinging arms 10*a*, 10*b* and rocker arm 15 according to arrows "B" and "C" respectively. The front and rear portions 5*a*, 5*b* and 6*a*, 6*b* will therefore adapt themselves to the new work conditions, without on the other hand modifying the specific pressure exerted on the individual fabric pieces.

Likewise, when the presser foot 1 encounters thickness variations on the individual fabric pieces, due to the presence of flaps or ribbon-like inserts extending transversely to the sewing direction, the front and rear portions 5*a*, 5*b* and 6*a*, 6*b* will easily step over said discontinuity by rotating about their hinging points with the side rocker arms 7*a*, 7*b* as shown by arrows "D" in FIG. 2.

At the moment that the front portions 5*a*, 5*b* act on workpiece lengths having greater or smaller thickness than the lengths on which the rear portions 6*a*, 6*b* act, the side rocker arms 7*a*, 7*b* will rotate about their fulcra, in the manner shown by arrow "E", so as to adjust the positioning in height of the front and rear portions, still keeping the specific pressure applied thereto constant.

It will be also recognized that during the execution of all the above described movements, the front and rear portions 5*a*, 5*b* and 6*a*, 6*b* of shoe 4 are always parallel to the needle plate in the transverse direction to the sewing direction.

The present invention achieves the intended aims.

It is noted in fact that the self-adjusting possibilities of the presser foot in question enable qualitatively excellent seams to be obtained even on workpieces having strong thickness variations.

The fact that the position of the knives is completely independent of that of the shoe enables the shoe portions to be raised and lowered without important variations in the cutting operation and subsequent overlapping operation of the fabric piece edges being involved.

It is also to be pointed out that the locator element 41 associated with the movable knife 33 and acting on the slide surface 40*a*, avoids the vertical thrusts resulting from the oscillations undergone by the presser foot 1 being discharged on the cutting edges of knives 32 and 33. Advantageously, this results in a reduced wear of the knives.

In addition, the danger that the knives may move apart from each other by effect of the cutting efforts is eliminated by the presence of dowel 45 acting on the movable knife 33.

Obviously, many modifcations and variations may be made to the invention as conceived, all of them falling within the scope of the inventive idea characterizing it.

What is claimed is:

1. A self-adjusting presser foot in combination with a sewing machine, comprising:

a small bearing frame (2) fixedly fastened to a presser bar (3) of the sewing machine;

a shoe (4) engaged at a lower part of the small bearing frame (2), said shoe having a longitudinal opening (29) for receiving and guiding two opposite edges of two fabric pieces disposed in mutual side by side relation, said shoe having has a transverse slit (49) for accessing sewing means;

cutting means (31) positioned upstream of the transverse slit (49) and close to said longitudinal opening (29) for trimming the side by side fabric piece edges; and said shoe having guide means (46) positioned at one end of said longitudinal opening (29) and acting downstream of the cutting means (31) and upstream of the transverse slit (49) for overlapping the trimmed fabric piece edges, wherein said shoe (4) comprises:

a pair of front portions (5*a*, 5*b*) disposed parallel is side by side relation and defining said longitudinal slit (29);

a pair of rear portions (6*a*, 6*b*) each disposed in alignment with one of said front portions (5*a*, 5*b*);

a pair of side rocker arms (7*a*, 7*b*) each of which oscillably engages, according to horizontal axes transverse to the sewing direction, one of said front portions (5*a*, 5*b*) and one of said rear portions (6*a*, 6*b*) in respective alignment;

a pair of interconnecting elements (10*a*, 10*b*) oscillatably engaged to the small bearing frame (2) and each carrying a fulcrum pin (14*a*, 14*b*) for one of said side rocker arms (7*a*, 7*b*), the axes of oscillation of said side rocker arms (7*a*, 7*b*) being oriented horizontally in a direction perpendicular to the sewing direction;

a center rocker arm (15) oscillatably engaged to the small bearing frame (2) according to a horizontal axis parallel to a sewing direction and said rocker arms having opposite ends (15*a*, 15*b*) operatively connected to the interconnecting elements (10*a*, 10*b*) in order to balance the fulcrum pins (14*a*, 14*b*) of the side rocker arms (7*a*, 7*b*).

2. The presser foot of claim 1, wherein said interconnecting elements comprise a pair of swinging arms (10*a*, 10*b*) each of the swinging arms having has one end (11*a*, 11*b*) connected to the small bearing frame (2) and a second end (13*a*, 13*b*) connected to one of said side rocker arms (7*a*, 7*b*); and the axes of oscillation of said swinging arms (10*a*, 10*b*) being oriented horizontally in a direction perpendicular to the sewing direction.

3. The presser foot of claim 2, wherein said center rocker arm (15) is connected to the swinging arms (10*a*, 10*b*) by a pair of connecting pistons (17*a*, 17*b*), said pistons being slidably engaged in a vertical direction to the small bearing frame (2), each piston having an engagement seat (18*a*, 18*b*) connected to an end projection (15*a*, 15*b*) of the center rocker arm (15) and each piston having a holding seat (19*a*, 19*b*) connected to a fitting lug (20*a*, 20*b*), and said fitting lug being carried by the respective swinging arms (10*a*, 10*b*).

4. The presser foot of claim 1, wherein said guide means (46) comprises a first and a second wedge-shaped wing (47*a*, 47*b*), each of said first and second wings extending from one shoe front portion (5*a*, 5*b*) towards the other shoe front portion, said wedge-shaped wings (47*a*, 47*b*) being connected to the edges of said longitudinal opening by respective curvilinear side portions (47*c*, 47*d*) converging towards each other so as to guide the fabric piece edges in a mutual overlapping relation.

5. The presser foot of claim 1, wherein said shoe (4) further comprises a presser element (21) located between said rear portions (6*a*, 6*b*) and acting on the assembled fabric piece edges downstream of said transverse slit (29).

6. The presser foot of claim 5, wherein said presser element (21) comprises an additional shoe portion (22) interposed between said rear portions (6*a*, 6*b*), said additional shoe portion (22) oscillatably connected to an additional arm (23), said additional arm 23 oscillatably linked to the small bearing frame (2), spring means (12, 25) connected to said frame (2) and said additional arm (23) to elastically urge the additional shoe portion (22) towards the assembled fabric piece edges.

7. The presser foot of claim 6, wherein said spring means comprises: a connecting shaft (12) rotatably engaged through the small bearing frame (2), a horizontal axis of said connecting shaft (12) transverse to the sewing direction, said connecting shaft 12 rigidly fastened to the additional arm (23); and a torsion spring (25) connecting the connecting shaft (12) to the bearing frame (2).

8. The presser foot of claim 7, wherein said connecting shaft (12) is rotatably mounted to the first ends (11*a*, 11*b*) of said swinging arms (10*a*, 10*b*).

9. The presser foot of claim 1, further comprising stop means (27*a*, 27*b*) positioned for restraining the downward oscillation of the front portions (5*a*, 5*b*) of shoe (4).

10. The presser foot of claim 9, wherein said stop means comprises: one abutment seat (27*a*, 27*b*) on each of said front portions (5*a*, 5*b*) positioned to act against the corresponding rear portion (6*a*, 6*b*) for restraining the rotation of the front portion about the front portions hinging point; and at least a pair of second abutment seats (28*a*, 28*b*) on the additional shoe portion (22) providing an abutment seat for the rear portions (6*a*, 6*b*) to restrain the lifting of said rear portions following a rotation of the side rocker arms (7*a*, 7*b*) about the respective fulcrum pins (14*a*, 14*b*).

11. The presser foot of claim 1, wherein said cutting means (31) comprises: a fixed knife (32) rigidly connected to the small bearing frame (2), said fixed knife being located close to said longitudinal opening (29), and a movable knife (33) hanging in cantilevered fashion from a driving rod (34), said fixed knife (32) and movable knife (33) positioned vertically to the shoe (4).

12. The presser foot of claim 1, wherein the fixed knife (32) is rigidly connected to a console-shaped supporting element (36) and said supporting element standing vertically to the small bearing frame (2).

13. The presser foot of claim 12, wherein the small bearing frame (2) has a guide ridge (37) said console-shaped supporting element (36) is slidably guided on said guide ridge (37) and a locking member (38) connected to said frame and said supporting element to fixedly attach said console to said frame according to a desired vertical positioning.

14. The presser foot of claim 13, further comprising a vertical adjusting headless screw (39) engaged in a plate-like projection (39*a*) carried by the console-shaped element, said screw (39) operating in abutment on said locking member (38) in order to stop the descent of the console-shaped element when the locking member (38) is loosened.

15. The presser foot of claim 11, wherein said small bearing frame (2) has a support portion (40) with a slide surface (40*a*), a locator element (41) connected to the movable knife (33), said support portion (40) being positioned to bear vertical thrust actions transmitted to the movable knife (33).

16. The presser foot of claim 15, wherein said locator element (41) comprises a ball bearing rotatably connected to the driving rod (34).

17. The presser foot of claim 11, wherein said small bearing frame (2) has a front extension (44), a vertically extended threaded dowel (45) passing through said exterior, said dowel having one end against the movable knife (33) to counteract the movable knife from moving away from the fixed knife (32) while cutting is being carried out.

* * * * *